US008154565B2

(12) United States Patent
Shi

(10) Patent No.: US 8,154,565 B2
(45) Date of Patent: Apr. 10, 2012

(54) APPARATUS AND METHOD FOR GAMMA CORRECTION

(75) Inventor: Miaohong Shi, Tainan (TW)

(73) Assignee: Himax Imaging, Inc., Grand Cayman (KY)

( * ) Notice: Subject to any disclaimer, the term of this patent is extended or adjusted under 35 U.S.C. 154(b) by 794 days.

(21) Appl. No.: 12/061,527

(22) Filed: Apr. 2, 2008

(65) Prior Publication Data

US 2009/0251494 A1 Oct. 8, 2009

(51) Int. Cl.
*G09G 5/10* (2006.01)

(52) U.S. Cl. ..... 345/690; 345/589; 348/674; 382/274

(58) Field of Classification Search ..... 345/674, 345/690–699; 348/254; 382/274
See application file for complete search history.

(56) References Cited

U.S. PATENT DOCUMENTS

| | | | | |
|---|---|---|---|---|
| 2,760,008 | A * | 8/1956 | Schade | 330/95 |
| 3,604,841 | A * | 9/1971 | Ettlinger et al. | 348/675 |
| 4,489,349 | A * | 12/1984 | Okada | 348/674 |
| 7,265,795 | B2 * | 9/2007 | Ohyama et al. | 348/675 |
| 7,382,382 | B2 * | 6/2008 | Furukawa et al. | 345/690 |
| 2007/0091019 | A1 * | 4/2007 | Park et al. | 345/63 |
| 2007/0115441 | A1 * | 5/2007 | Berman | 353/97 |

* cited by examiner

*Primary Examiner* — Alexander Eisen
*Assistant Examiner* — Sanjiv D Patel
(74) *Attorney, Agent, or Firm* — Stout, Uxa, Buyan & Mullins, LLP

(57) ABSTRACT

Apparatus and method for gamma correction are disclosed. An adjustable blending unit is utilized for adjustably blending a linear gamma function with a nonlinear gamma function, thereby resulting in an adjustable gamma curve. The nonlinear gamma function is adjustable by a blending parameter such that distance of the gamma curve to linear gamma curve may be changed.

16 Claims, 3 Drawing Sheets

APPARATUS AND METHOD FOR GAMMA CORRECTION

BACKGROUND OF THE INVENTION

1. Field of the Invention

The present invention generally relates to gamma correction, and more particularly to gamma correction using adjustable and adaptable curve function.

2. Description of the Prior Art

Most display systems possess a nonlinear relationship known as the gamma response characteristic, in which the display systems do not display brightness that is perfectly proportional to the input voltage. Because of the gamma property, image signals are usually pre-compensated by a gamma curve to inversely compensate for the nonlinearities of the display systems.

Lookup table (LUT) is one approach to the conventional gamma correction. However, the LUT method disadvantageously requires a great amount of memories, and retrieving data from the memories results in more access cycles. Piecewise linear approximation is another approach to the conventional gamma correction. Nevertheless, the piecewise linear method needs a number of registers for storing end points, and likely incurs approximation errors.

Accordingly, a need has arisen to propose a fast and simple way for gamma correction.

SUMMARY OF THE INVENTION

In view of the foregoing, it is an object of the present invention to provide a fast and simple way for gamma correction. The disclosed gamma correction and its associated gamma curve require substantially less computation compared to conventional gamma correction methods. Moreover, users may conveniently scale the shape and adjust the strength of the gamma curve.

According to the embodiment of the present invention, an adjustable blending unit is utilized for adjustably blending a linear gamma function with a nonlinear gamma function, thereby resulting in an adjustable gamma curve. The nonlinear gamma function is adjustable by a blending parameter such that distance of the gamma curve to the linear gamma curve may be changed. The gamma curve is further adjustable by a strength parameter such that curvature of the gamma curve may be changed.

DETAILED DESCRIPTION OF THE INVENTION

Figure 1:
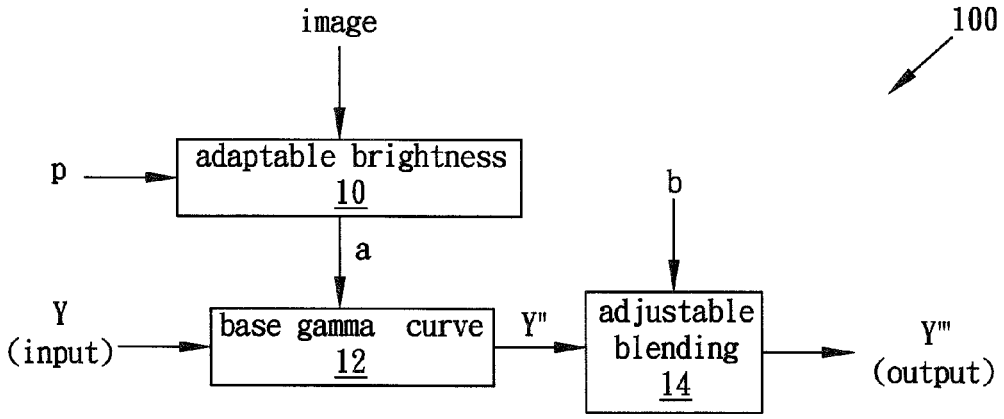
FIG. 1 shows a block diagram illustrating apparatus for gamma correction according to one embodiment of the present invention.
Figure 2:
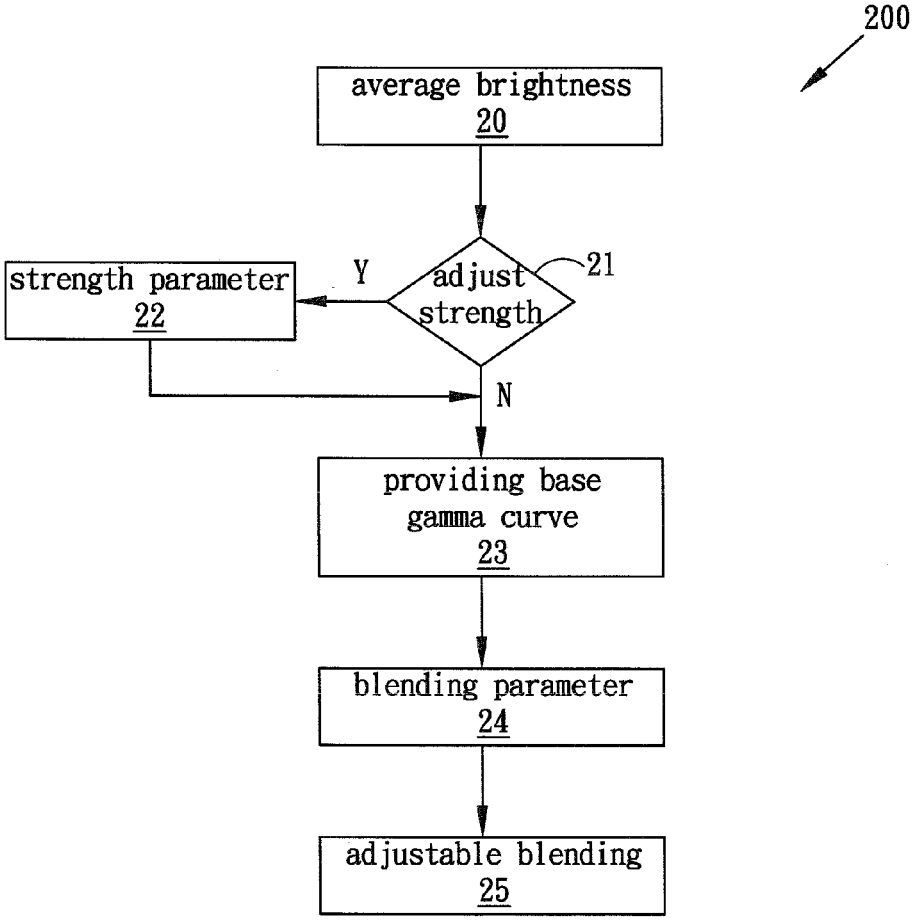
FIG. 2 shows a flow diagram illustrating a method for gamma correction according to the embodiment of the present invention.

FIG. 1 shows a block diagram illustrating apparatus 100 for gamma correction according to one embodiment of the present invention, and FIG. 2 shows a flow diagram illustrating a method 200 for gamma correction according to the embodiment of the present invention. In the embodiment, the apparatus 100 and method 200 are utilized to compensate for nonlinearity of a display system, such as liquid crystal display (LCD). However, the present invention could be well applicable to other systems. For example, the gamma correction disclosed herein could be applied, with or without modification, for correcting the nonlinear response of a photosensor. Moreover, in the embodiment, 8 bits are used for representing the pixel, and thus 256 levels (0-255) are available for the brightness. It is appreciated by those skilled in the art that the number of bits representing the pixel may be other than 8 in accordance with the design need of a specific system.

In the embodiment, gamma correction curve (or transfer function) is defined as follows:

$$Y'=(255+a)*Y/(a+Y) \quad (1)$$

$$Y''=(Y'*(255-Y)+Y^2)/255 \quad (2)$$

$$Y'''=Y+(Y''-Y)*b \quad (3)$$

$$a=\text{round}\ (\text{avgBrightness}*p) \quad (4)$$

where Y is the brightness (or luma value) of an input pixel,

Y' is an intermediate output,

Y" is the output of a base gamma curve,

Y'" is the brightness of an output pixel, p is a parameter that defines the strength of the gamma correction, and b is a parameter that defines the closeness of the gamma curve to the linear gamma curve.

The avgBrightness in (4) represents the average brightness of a present image. In the exemplified embodiment, in step 20 (FIG. 2), the pixels of a whole image frame or a portion of the image frame under gamma correction (also known as a window) are operated by an adaptable brightness unit 10 (FIG. 1) to obtain their average brightness. In this specification, the term unit is used to denote a circuit, a piece of program, or their combination. The obtained average brightness affects the output Y' in (1) through the brightness value "a", and further affects the output Y" in (2) and the output Y'" in (3). Accordingly, the apparatus 100 and method 200 are adaptable and are thus able to automatically change their gamma correction in order to deal with varied average brightness. This is particularly useful when the apparatus 100 receives various input sources from different imaging devices that have distinct average brightness.

In steps 21-22, the brightness value "a" may be further adjusted. Specifically speaking, in step 21, if the strength of the gamma correction needs adjustment, a strength parameter p is retrieved or inputted, for example, by a user (in step 22) to the adaptable brightness unit 10. In the embodiment, this adjustment is done by multiplying the average brightness (avgBrightness) by the parameter p in (4). The operator "round" in (4) represents the mathematical rounding operation. It is appreciated by those skilled in the art that the rounding operation may be omitted if the apparatus 100 is a non-integer system. (The effect of the parameter p on the gamma correction will be addressed later.)

Figure 3:
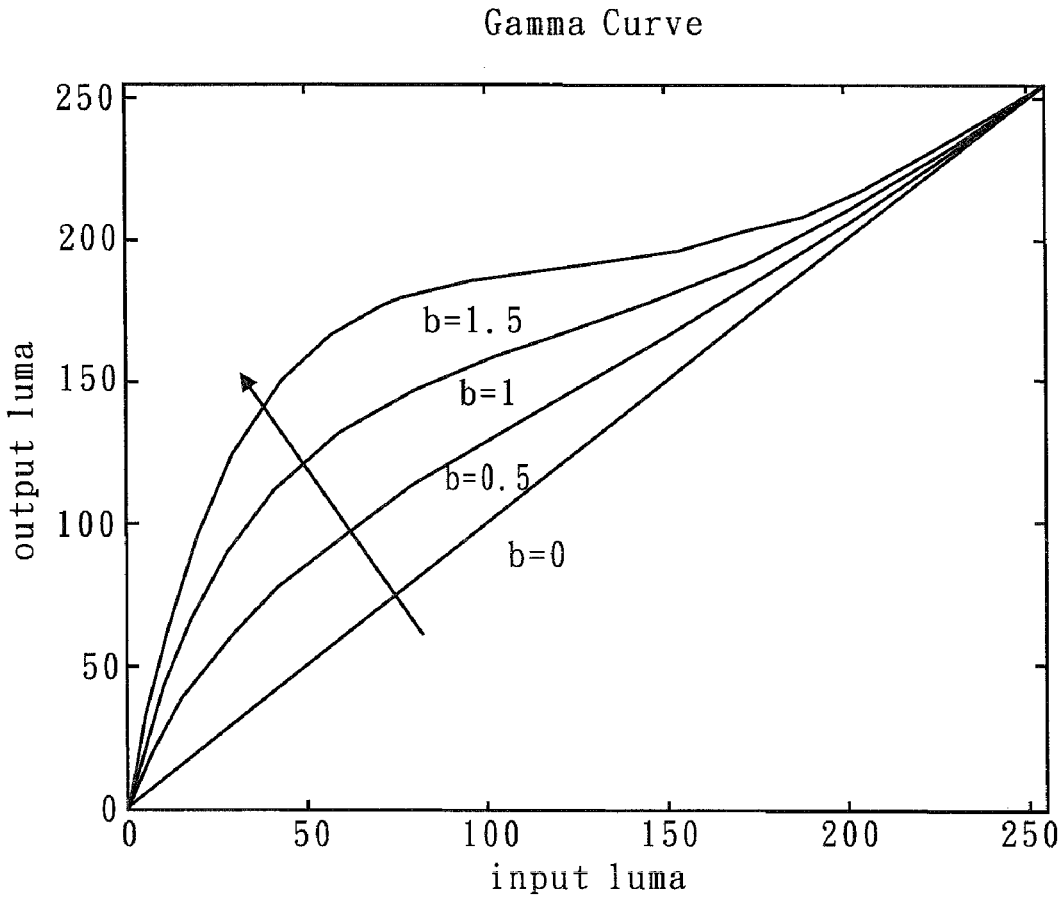
FIG. 3 shows various gamma curves with different blending parameters.

The function Y" expressed in (2) represents a base gamma curve (step 23 and block 12) corresponding to the gamma curve when b=1 as shown in FIG. 3. In the embodiment, the base gamma curve is a second-order function. However, a base gamma curve defined by higher-order function could be well used.

The function Y'" expressed in (3) represents a general gamma curve. The function Y'" is made up or blended by at least two portions—a linear portion Y and a nonlinear portion (Y"−Y). The blending (step 25) of the function Y'" is done by multiplying the nonlinear portion (Y"−Y) by a blending parameter b, for example, inputted by a user (in step 24) in an adjustable blending unit 14. It is noted that the general gamma curve Y'" becomes the base gamma curve Y" when b=1; and the general gamma curve Y'" becomes linear gamma curve when b=0. It is observed in FIG. 3 that the distance of the gamma curve Y'" (b≠0) to the linear gamma curve (b=0, in which no gamma correction is performed) increases as the value of the blending parameter b increases and vice versa. It is also observed in FIG. 3 that the various gamma curves converge on both ends (i.e., 255 and 0 in this example).

Figure 4:
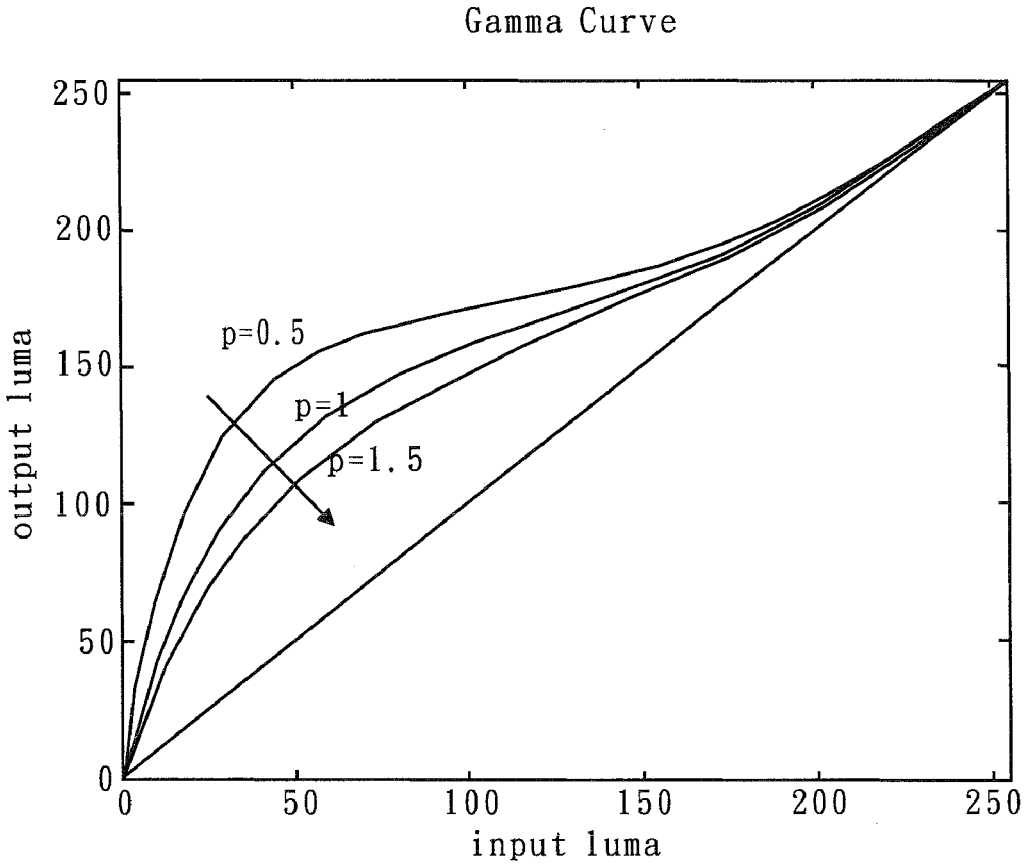
FIG. 4 shows various gamma curves with different strength parameters.

As discussed above, the base gamma curve is a function of the brightness value "a", which is further dependent on the strength parameter p, if the strength adjustment is selected. FIG. 4 shows various gamma curves with different parameters p. Specifically speaking, the curvature of the gamma curve Y'" increases as the value of the strength parameter p decreases and vice versa. In the embodiment, a parameter p with value less than 1 makes the gamma correction more aggressive (or larger curvature), and alternatively, a parameter p with value greater than 1 makes the gamma correction less aggressive (or less curvature).

Accordingly, the embodiment of the present invention provides apparatus and method in a fast and simple way for gamma correction. The disclosed gamma correction and its associated gamma curve require substantially less computation compared to the conventional gamma correction methods. Moreover, users may conveniently scale the shape and adjust the strength of the gamma curve. Further, a single register with, for example, 6 bits is sufficient for storing both the blending parameter b and the strength parameter p in this embodiment. The apparatus and method of the present embodiment may adaptably and automatically change their gamma correction according to varied average brightness.

Although specific embodiments have been illustrated and described, it will be appreciated by those skilled in the art that various modifications may be made without departing from the scope of the present invention, which is intended to be limited solely by the appended claims.

What is claimed is:

1. Apparatus for gamma correction, comprising:

an adjustable blending unit for adjustably blending a linear gamma function with a nonlinear gamma function, thereby resulting in an adjustable gamma curve;

wherein the nonlinear gamma function includes difference of a base gamma function that defines a base gamma curve and the linear gamma function; and wherein the base gamma function is:

$$Y''=(Y'*(255-Y)+Y^2)/255$$

where Y" is an output of the base gamma curve, Y is luma value of an input pixel, and Y' is an intermediate output and defined as $$Y'=(255+a)*Y/(a+Y)$$

where a=round(avgBrightness*p), avgBrightness represents average brightness of an image, round represents a mathematical rounding operation, and p is a parameter that defines strength of the gamma correction.

2. The apparatus of claim 1, wherein the nonlinear gamma function is adjustable.

3. The apparatus of claim 2, wherein the nonlinear gamma function is adjusted by a blending parameter such that distance of the gamma curve to linear gamma curve is changed, wherein the linear gamma curve represents a function in which no gamma correction is performed.

4. The apparatus of claim 1, wherein the base gamma function is a second-order function.

5. The apparatus of claim 1, wherein the base gamma function is a function of average brightness of an image.

6. The apparatus of claim 5, wherein the average brightness of the image is adjustable.

7. The apparatus of claim 6, wherein the average brightness of the image is adjusted by a strength parameter such that curvature of the gamma curve is changed.

8. The apparatus of claim 1, wherein the gamma curve is expressed by:

$$Y'''=Y+(Y''-Y)*b$$

where Y'" is brightness of an output pixel, and b is a parameter that defines closeness of the gamma curve to a linear gamma curve, wherein the linear gamma curve represents a function in which no gamma correction is performed;

wherein Y represents the linear gamma function, and (Y"−Y) represents the nonlinear gamma function.

9. A method for gamma correction, comprising:

adjustably blending a linear gamma function with a nonlinear gamma function, thereby resulting in an adjustable gamma curve;

wherein the nonlinear gamma function includes difference of a base gamma function that defines a base gamma curve and the linear gamma function; and wherein the base gamma function is:

$$Y''=(Y'*(255-Y)+Y^2)/255$$

where Y" is an output of the base gamma curve, Y is luma value of an input pixel, and Y' is an intermediate out and defined as $$Y'=(255+a)*Y/(a+Y)$$

where a=round(avgBrightness*p), avgBrightness represents average brightness of an image, round represents a rounding operation, and p is a parameter that defines strength of the gamma correction.

10. The method of claim 9, wherein the nonlinear gamma function is adjustable.

11. The method of claim 10, further comprising a step of adjusting the nonlinear gamma function, by a blending parameter such that distance of the gamma curve to linear gamma curve is changed, wherein, the linear gamma curve represents a function in which no gamma correction, is performed.

12. The method of claim 9, wherein the base gamma function is a second-order function.

13. The method of claim 9, wherein the base gamma function is a function of average brightness of an image.

14. The method of claim 13, wherein the average brightness of the image is adjustable.

15. The method of claim 14, further comprising a step of adjusting the average brightness of the image by a strength parameter such that curvature of the gamma curve is changed.

16. The method of claim 9, wherein the gamma curve is expressed by:

$$Y'''=Y+(Y''-Y)*b$$

where Y'" is brightness of an output pixel, and b is a parameter that defines closeness of the gamma curve to a linear gamma curve, wherein the linear gamma curve represents a function in which no gamma correction is performed;

wherein Y represents the linear gamma function, and (Y"−Y) represents the nonlinear gamma function.

* * * * *